US006650307B1

(12) United States Patent
Toda et al.

(10) Patent No.: US 6,650,307 B1
(45) Date of Patent: Nov. 18, 2003

(54) METHOD OF DRIVING DISPLAY PANEL AND PANEL DISPLAY APPARATUS

(75) Inventors: Kosaku Toda, Kawasaki (JP); Toshio Ueda, Kawasaki (JP); Takayuki Ooe, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 120 days.

(21) Appl. No.: 09/697,717

(22) Filed: Oct. 27, 2000

(30) Foreign Application Priority Data

Mar. 30, 2000 (JP) ..... 2000-095037

(51) Int. Cl.[7] ..... G09G 3/28
(52) U.S. Cl. ..... 345/63; 345/60; 345/66
(58) Field of Search ..... 345/55, 60, 63, 345/66, 596

(56) References Cited

U.S. PATENT DOCUMENTS

| | | | | |
|---|---|---|---|---|
| 5,757,343 A | | 5/1998 | Nagakubo | 345/63 |
| 5,898,414 A | * | 4/1999 | Awamoto et al. | 345/55 |
| 6,037,917 A | * | 3/2000 | Kawakami | 345/60 |
| 6,052,112 A | * | 4/2000 | Tanaka et al. | 345/596 |

FOREIGN PATENT DOCUMENTS

| | | |
|---|---|---|
| EP | 0 653 740 A2 | 5/1995 |
| EP | 0 841 652 A1 | 5/1998 |
| EP | 0 965 974 A4 | 12/1999 |
| JP | 8-286636 | 11/1996 |

OTHER PUBLICATIONS

English Language Translation of Japanese Patent Publication No.: 06 259034.

* cited by examiner

*Primary Examiner*—Steven Saras
*Assistant Examiner*—Uchendu O. Anyaso
(74) *Attorney, Agent, or Firm*—Staas & Halsey LLP

(57) ABSTRACT

A method of driving a display panel, and a panel display apparatus, in which displays do not lack realism even when power control is performed, have been disclosed. In the display panel driving method, the display frame for a screen is comprised of plural subframes, each being assigned a number of times discharge for light emission is performed according to the specified luminance relation, the representation with gray scale is performed by combining the subframes that display according to the intensity of the input image signal for each cell, and the power consumption is controlled by both the control of the total number of times discharge for light emission is performed of the display frame and the control of the gain of the input image signal.

26 Claims, 7 Drawing Sheets

METHOD OF DRIVING DISPLAY PANEL AND PANEL DISPLAY APPARATUS

BACKGROUND OF THE INVENTION

The present invention relates to a method of driving a display panel of a plasma display panel (referred to as PDP hereinafter) or the like, and a panel display apparatus employing the method. More particularly, the present invention relates to a method of driving a display panel in which displays with gray scale are performed by weighting each subframe to change the discharge and light emission period for display, and a panel display apparatus employing same.

Recently, in the field of display apparatus, demands for a thinner, larger-screen, and higher-resolution display apparatus are increasing information to be displayed and conditions under which display apparatuses are installed are becoming more diversified, and a display apparatus to meet these demands and cope with the diversification is required. There are several types of thin display apparatuses such as LCDS, fluorescent display tubes, ELs, PDPs, and so forth. In a fluorescent display tube, EL, or PDP, gray scale display is realized, in general, by dividing a display frame into plural subframes, weighting each subframe period, and displaying each bit of the gray scale data using a corresponding subframe. Though the following explanation will use a PDP as an example, the detailed explanation of a PDP itself is omitted here because it has been disclosed in Japanese Unexamined Patent Publication (Kokai) No. 9-160525 by the same applicants, and the gray scale representation by the subframe method and the power control relating to the present invention will be explained generally.

FIG. 1 is a block diagram showing the general structure of a general PDP display apparatus. In a panel 1, plural X electrodes and Y electrodes are arranged adjacently in turn and plural address electrodes are arranged in the direction that runs at a right angle to the aforementioned electrodes. The plural X electrodes are connected commonly, and are connected to an X driver 2. Each of the plural Y electrodes is connected to a Y driver 3. The plural address electrodes are connected to an address driver 4. A power source 5 supplies power to the X driver 2, the Y driver 3, and the address driver 4.

Though it is assumed that the input image signals are RGB digital signals, in some cases they may be analog signals and, in such a case, they are converted into digital data by an A/D converter. The input image signal is amplified by digital operations in a gain control circuit 11 and stored temporarily in a frame memory 13 by a data converter 12. At this time, the input image signal is loaded into the display plane of the frame memory 13 according to a subframe format, which will be explained later, read from each display plane according to the subframe to be displayed, and supplied to the address driver 4 as address data. The data converter 12 counts the number of lit pixels for each subframe when storing the input image signal into the frame memory 13, calculates the display load ratio, and then sends them to a driver controller 14. The display load ratio relates to the sum of light emission intensity of all cells, that is, the total number of discharge pulses for light emission (radiation pulses) in the entire panel (referred to briefly as a number of pulses in some cases hereinafter). The driver controller 14 supplies a certain gain coefficient to the gain control circuit 11, where the input image signal is multiplied by the gain coefficient. The gain coefficient is stored in a ROM or the like as a value fixed in advance, or can be set by a control that adjusts the display luminance. When the gain coefficient is set by a luminance control circuit using a variable resistor, it can be changed externally, but it is not changed automatically according to the input image signal.

A power control circuit 15 calculates the total number of pulses for a display frame based on the values of voltage and current supplied by the power source 5 and the display load ratio supplied by the driver controller 14, determines the number of radiation pulses for each subframe (SF) according to the total number of pulses, and supplies them to the driver controller 14. The period of a display frame is specified by the vertical synchronizing signal (Vsync) supplied from the outside and the signal vsync is supplied to the gain control circuit 11, the data converter 14, and the power control circuit 15, and is also supplied to the driver controller 14 via the power control circuit 15.

The driver controller 14 generates and puts out drive signals that control the X driver 2, the Y driver 3, the address driver 4, the data converter, and so forth, based on the abovementioned number of radiation pulses for each SF, Vsync, and clocks from a clock source (not shown). According to the drive signals supplied from the driver controller 14, each part generates a drive signal (waveform) to be applied to the panel 1.

FIG. 2 shows drive signals of a subframe in a PDP display apparatus of a so-called write address type, in which the address period and the sustaining discharge period are separated. The subframe will be explained later. The operations of a PDP display apparatus are explained with reference to FIG. 2. In this example, a subframe is divided into the reset period, the address period, and the sustaining discharge period. In the reset period, all cells are set to the same status. In the address period, scan pulses are applied to the Y electrodes sequentially, and address pulses are synchronously applied to the address electrodes according to the display data (address data). While scan pulses are applied to the Y electrode of a line, address pulses are applied to the address electrode of a cell that is caused to emit light among the cells of the line, and address pulses are not applied to the address electrode that is not caused to emit light. In the cell to which address pulses are applied, address discharge is caused to occur and wall-charge is accumulated on the surface of the electrode of the cell. This process is applied to all lines in succession. As a result, all cells are set to a status in accordance with the display data of the subframe, and wall-charge accumulates. In the sustaining discharge period, sustaining pulses are applied to the Y electrodes and the X electrodes alternately, and discharge is caused to occur in a cell in which wall-charge has accumulated and the cell emits light. In this case, the luminance is determined by the length of the sustaining discharge period, in other words, the number the sustaining pulses (number of times discharge for light emission is performed).

The gray scale representation in a PDP is realized by dividing a display frame into plural subframes and by combining the lit subframes. The luminance of each subframe is determined based on the number of the sustaining pulses. Though the luminance ratio of each subframe may be set at a special ratio in order to suppress the problem of color false contour, in a subframe structure as shown in FIG. 3, each term of the luminance ratio is a value of 2 to the nth power and the number of gray levels for a certain number of subframes is the maximum, therefore, this structure is widely used. In FIG. 3, the ratio of the number of sustaining discharge pulses of six subframes SF0 through SF5 is 1:2:4:8:16:32, and 64 gray levels can be represented by combining them, and each bit of the 6-bit display data corresponds to SF0 through SF5 in this order. For example, when the gray level of a display data of a cell is the $25^{th}$ (1A in the hexadecimal system), SF1, SF3, and SF4 are lit and other SF0, SF2, and SF5 are not lit. Here, the total number of sustaining pulses of all the subframes of a display frame is referred to as the total number of radiation pulses n. That is, the total number of radiation pulses is the number of sustaining pluses when all the subframes are lit, and is also the number of pulses that can be lit to the maximum extent for a cell during a display frame, for example, 63 in FIG. 3.

Generally, display data supplied from the outside has a format in which the gray level of each pixel is continuous and cannot be changed to a format acceptable for the subframe directly. Therefore, the display data is stored into the frame memory 13 temporarily, read according to the format of the subframe, and then supplied to the address driver 4. In each subframe, the operation as shown in FIG. 2 is performed and only the length of the sustaining discharge period (that is, the number of sustaining pulses) differs in each subframe.

When a bright image is displayed, the number of discharge pulses for light emission of each cell increases, the total number of radiation pulses of a display frame increases, and the power consumption, that is, the current consumption increases as a result. Here, the abovementioned display load ratio is used as a quantity that relates to the brightness of the displayed image. The maximum number of radiation pulses of a display frame for the entire screen is achieved when all the cells are lit with all the radiation pulses, and the display load ratio is a ratio of the total number of radiation pulses for light emission of all cells for a display frame to the maximum number of radiation pulses. The display load ratio is 0% when all cells are displayed in black, and 100% when all cells are displayed with the maximum luminance.

In the PDP display apparatus, since the current that flows during the sustaining discharge period influences the amount of current consumption significantly, the current consumption increases when the total number of radiation pulses of a display frame increases. FIG. 4 shows the relation between the display load and the power. If the number of sustaining pulses of each subframe, that is, the total number of radiation pulses n, is fixed, the power consumption P (or current consumption) increases as the display load ratio increases.

A limit to the power consumption is specified for the PDP display apparatus. It is possible to set the total number of radiation pulses n so that the power consumption is below the limit even when the display load ratio is the maximum, that is, all cells are lit with the maximum luminance. The display load ratio is, however, around 10% to tens of percents normally, and is seldom near 100%, and a problem that the normal display is rather dark may come up. Therefore, the power control is performed by the way in which the total number of pulses n is set so that the power consumption P reaches the limit when the display load ratio is A, and when the display load ratio exceeds A, the power consumption P is controlled to be below the limit by reducing the total number of radiation pulses n. In this way, the total number of radiation pulses n decreases when the display load ratio exceeds A, and the reduction in the total number of radiation pulses n is compensated for by allocating a number of sustaining pulses to each subframe according to the specified ratio. For example, in a case where a display frame is comprised of the six subframes SF0 through SF5 as shown in FIG. 3, the ratio of the numbers of sustaining pulses is set at 1:2:4:8:16:32, and the total number of radiation pulses n (total number of sustaining pulses) is 252, the ratio of the numbers of sustaining pulses for SF0 through SF5 is 4:8:16:32:64:128 when the display load ratio is A or less, and is set at 3:6:13:26:51:103 when the display load ratio exceeds A and the total number of pulses n is reduced by 20%, down to 202.

As mentioned above, when the display load ratio increases, power control is performed by the way in which the total number of radiation pulses n is reduced to suppress the power consumption, but when the total number of radiation pulses n is rather small, a subframe-weighted distribution of sustaining pulses is not available and a problem that the number of gray levels decreases because the subframe of SF0 is not lit. As shown in FIG. 5, when the display load ratio exceeds B, the total number of radiation pulses drops below C and a decrease of a number of gray levels may be caused. A finer display with a larger number of gray levels is required, and in a case where a display frame is comprised of eight subframes and the total number of radiation pulses n is 255, the number of radiation pulse of SF0 is 1. When the total number of radiation pulses n is reduced to 127, the number of radiation pulses of SF0 becomes zero. Therefore, a problem that the number of gray levels drops may occur. In an animation display, the display lacks realism when cells with the same intensity of luminance are contiguous in a wide area, therefore, a method called error diffusion, in which noise is added intentionally, is employed. In this case, however, the diffused bits are not lit when the subframe SF0 with the least luminance is not lit, and this brings up a problem that the display lacks realism.

Here, as shown in FIG. 6, it is possible to terminate the power control when the total number of pulses reaches C, but in this case a problem that the power consumption P exceeds the limit when the display load ratio exceeds B may come up.

SUMMARY OF THE INVENTION

The object of the present invention is to realize a method of driving the display panel that provides displays with realism even when the power is controlled, and a display apparatus employing the abovementioned panel display.

To realize the abovementioned object, the power consumption is controlled by means of both the control of the total number of times discharge for light emission is performed in the plural subframes and the control of the gain of input image signals.

FIG. 7 illustrates the principle of the present invention.

Actually, in the control of power consumption as shown in FIG. 7, the total number of times discharge radiation is performed (n) is reduced first when the display load ratio increases and exceeds A, with the gain G being fixed to a constant value, and the gain G is reduced when the total number of times discharge for light emission is performed drops to the threshold C, with the total number of times discharge for light emission is performed being fixed to the threshold C. The threshold C for the total number of times discharge is performed is determined based on the minimum number of times discharge is performed, which is required to maintain the specified relation of luminance between the plural subframes. It is preferable that the threshold can be set from the outside of the display panel.

According to the present invention, power can be controlled without the occurrence of a decrease in a number of gray levels or a display of a poor quality gray scale.

When the gain is reduced, the level of the input image signal is reduced and the allocated number of gray levels is also reduced. For example, when the gain is halved for an input image signal with 100 levels, the number of levels is also halved to 50 and the luminance drops because subframes are combined to display only 50 levels.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

Figure 8:
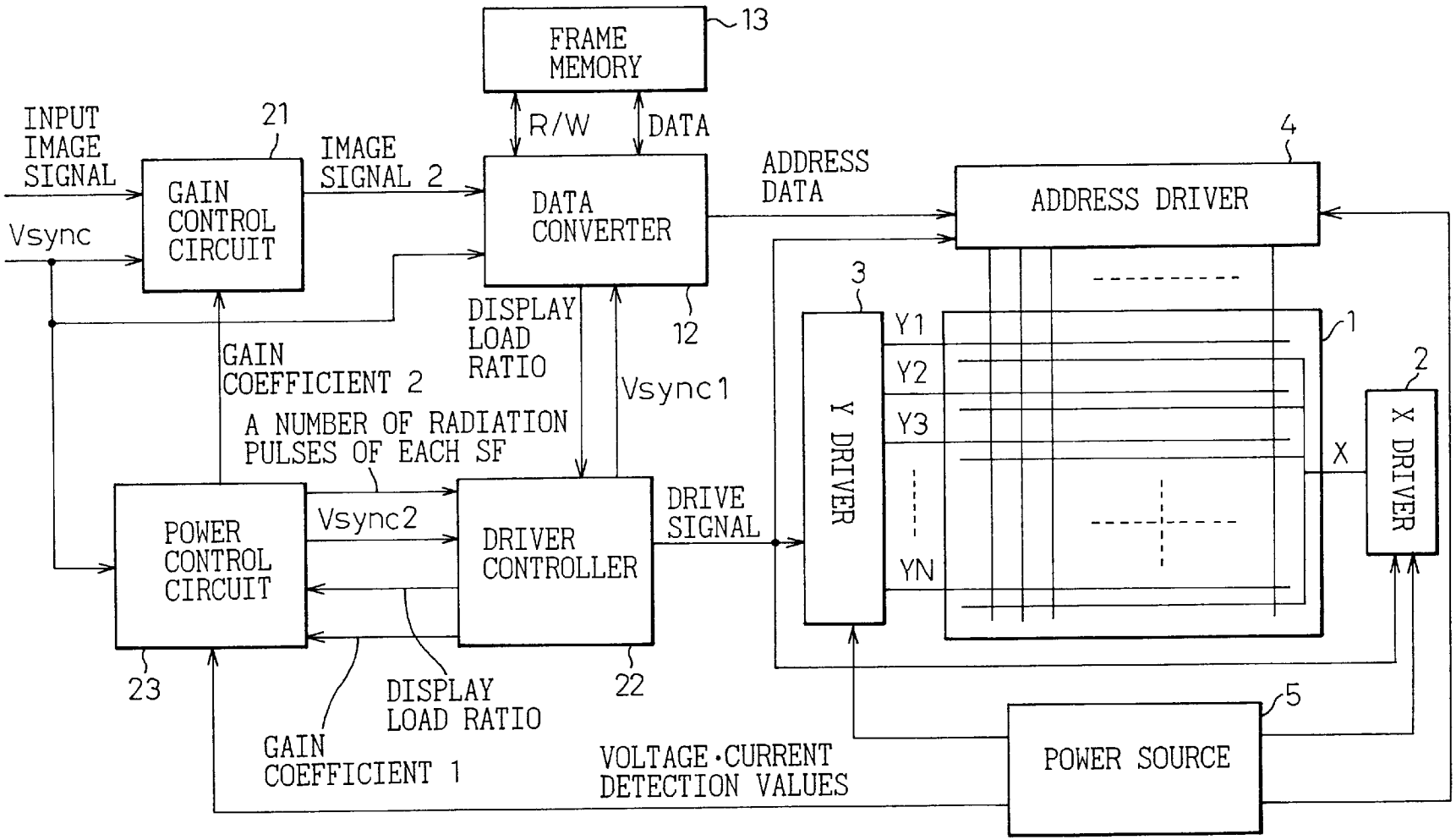
FIG. 8 is a schematic showing the entire structure of the PDP display apparatus in the embodiment of the present invention.

FIG. 8 is a schematic showing the entire structure of a PDP display apparatus in the embodiment of the present invention.

Figure 1:
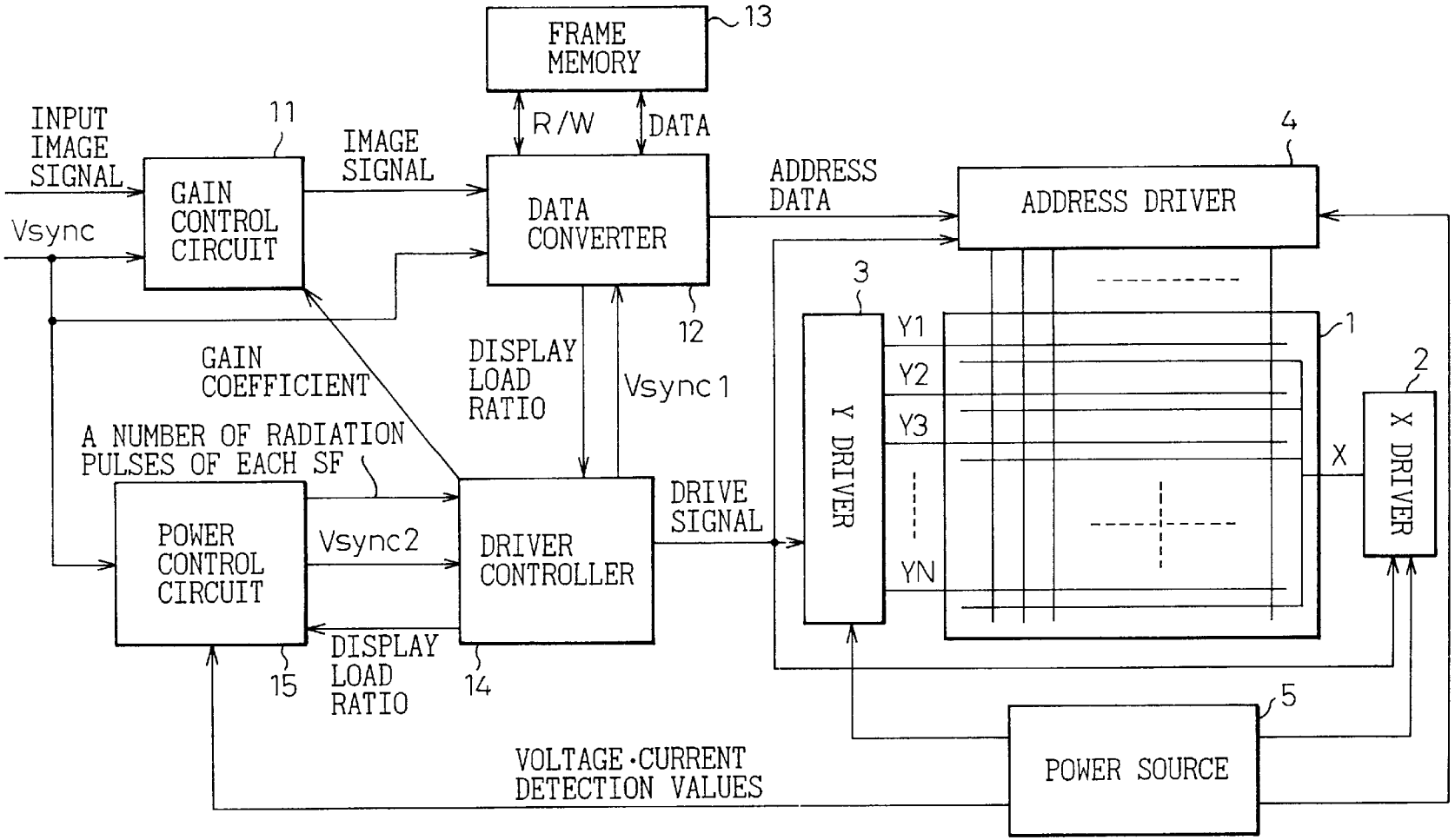
FIG. 1 is a block diagram showing the entire structure of a typical PDP display apparatus.
Figure 2:
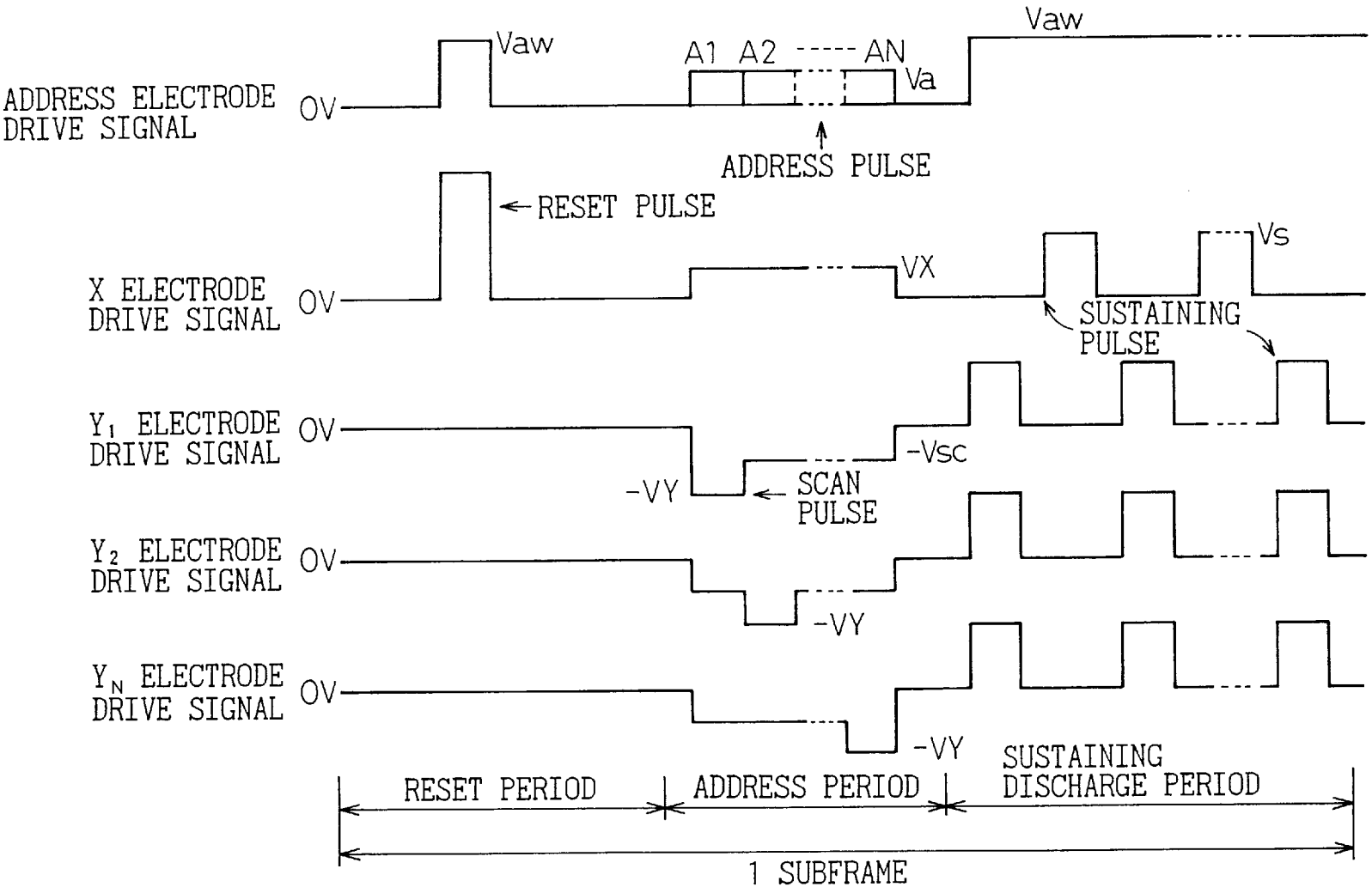
FIG. 2 is a time chart showing the drive signals of the PDP display apparatus.
Figure 3:
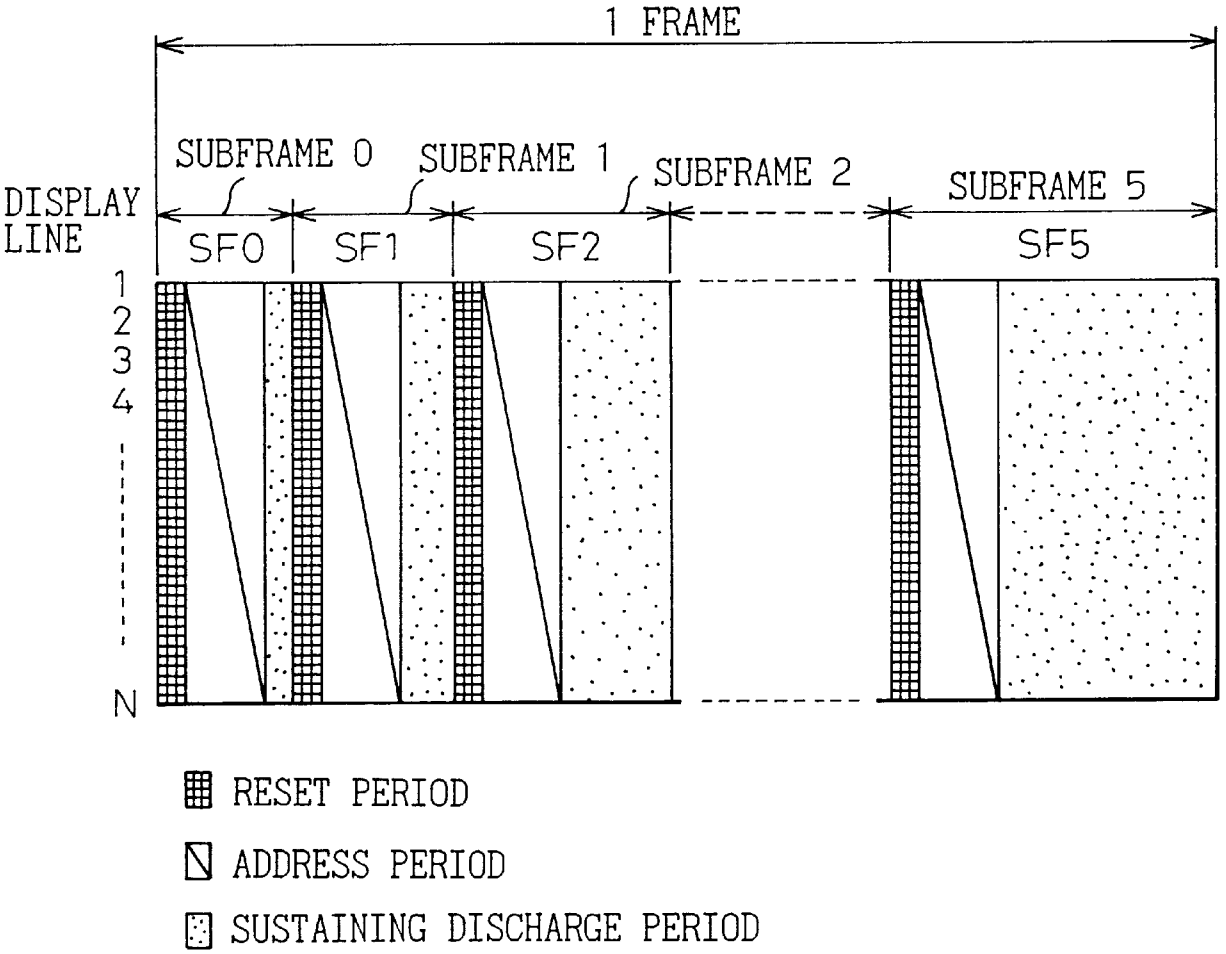
FIG. 3 is a time chart showing the address type, in which address and sustaining discharges are separated, to display gray levels in the PDP.
Figure 4:
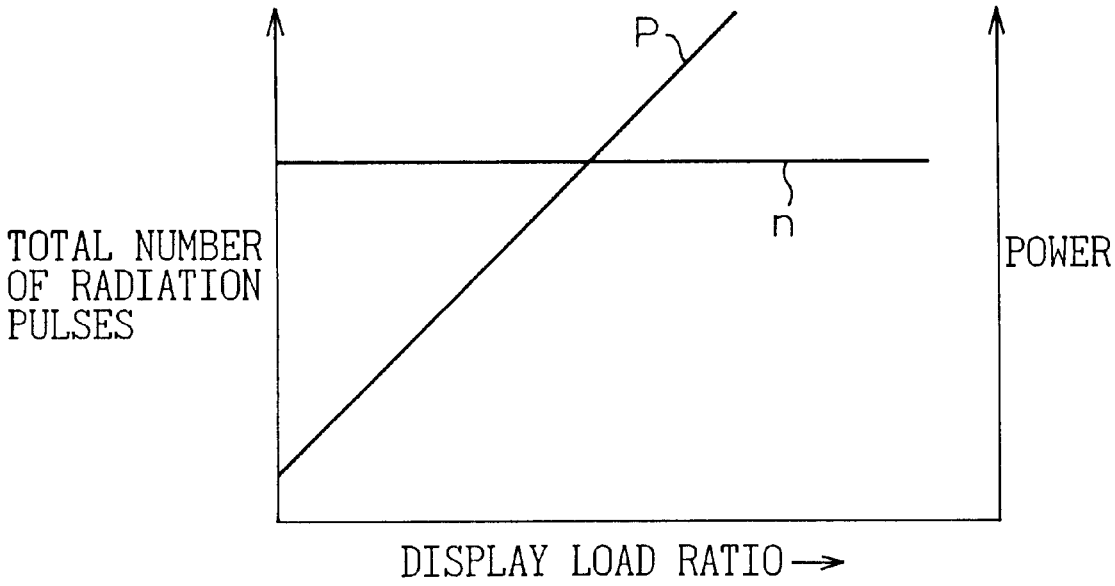
FIG. 4 is a schematic showing the relationship between display load and power consumption.
Figure 5:
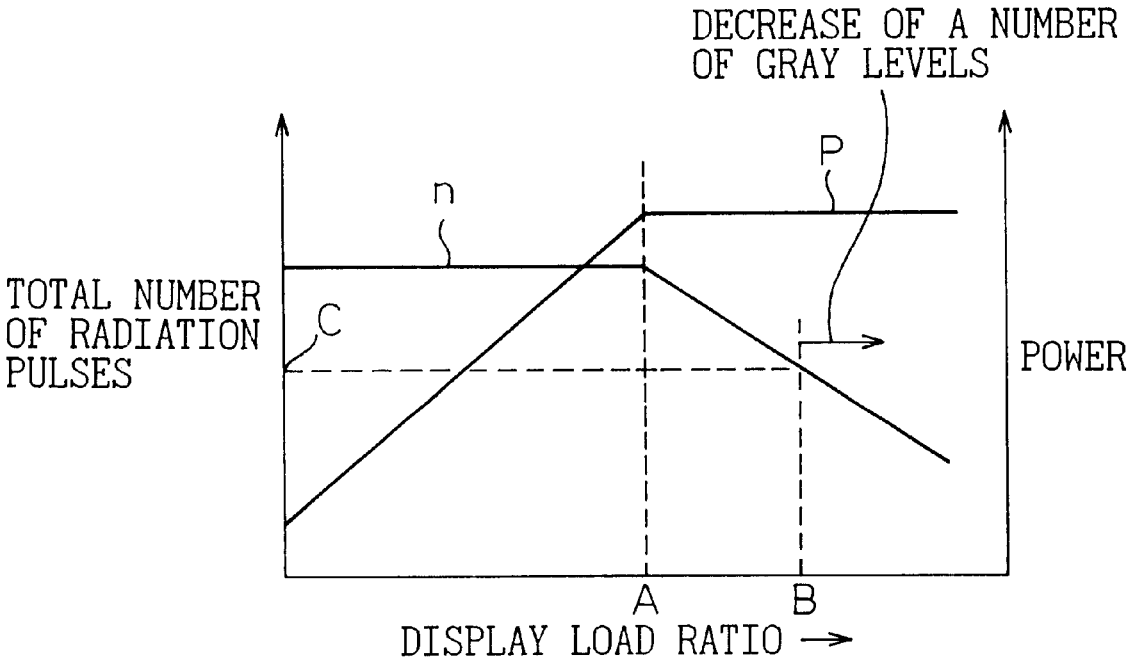
FIG. 5 is a schematic showing the relationship between display load and power consumption when the total number of radiation pulses is controlled.
Figure 6:
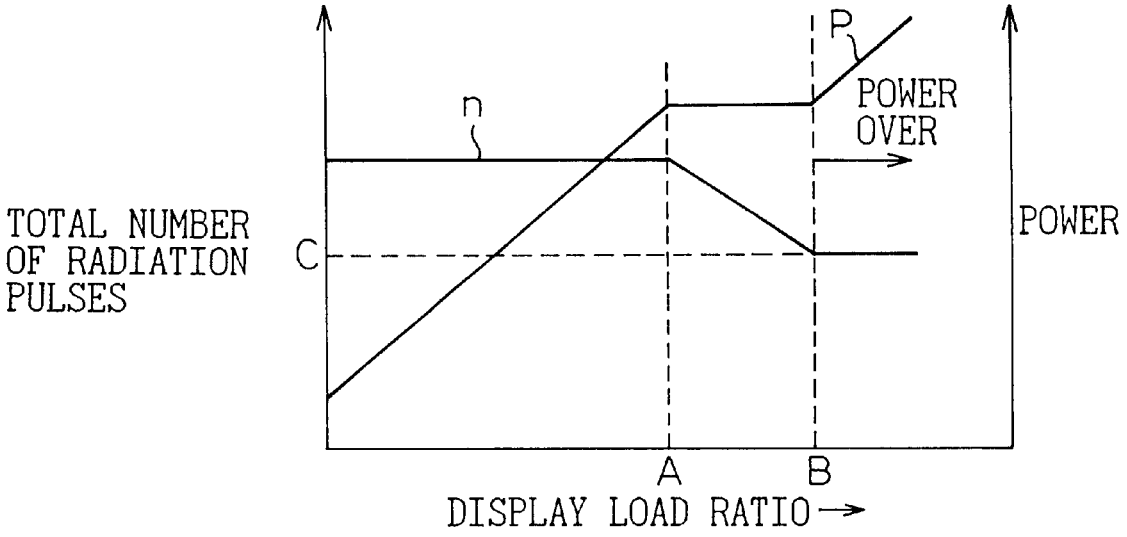
FIG. 6 is a schematic explaining the problem when the total number of radiation pulses is controlled.

As shown schematically, the PDP display apparatus in the present embodiment has a structure similar to that of the PDP display apparatus in FIG. 1, and only a gain control circuit 21, a driver controller 22, and a power control circuit 23 are different. Only the different parts are explained below.

Figure 9:
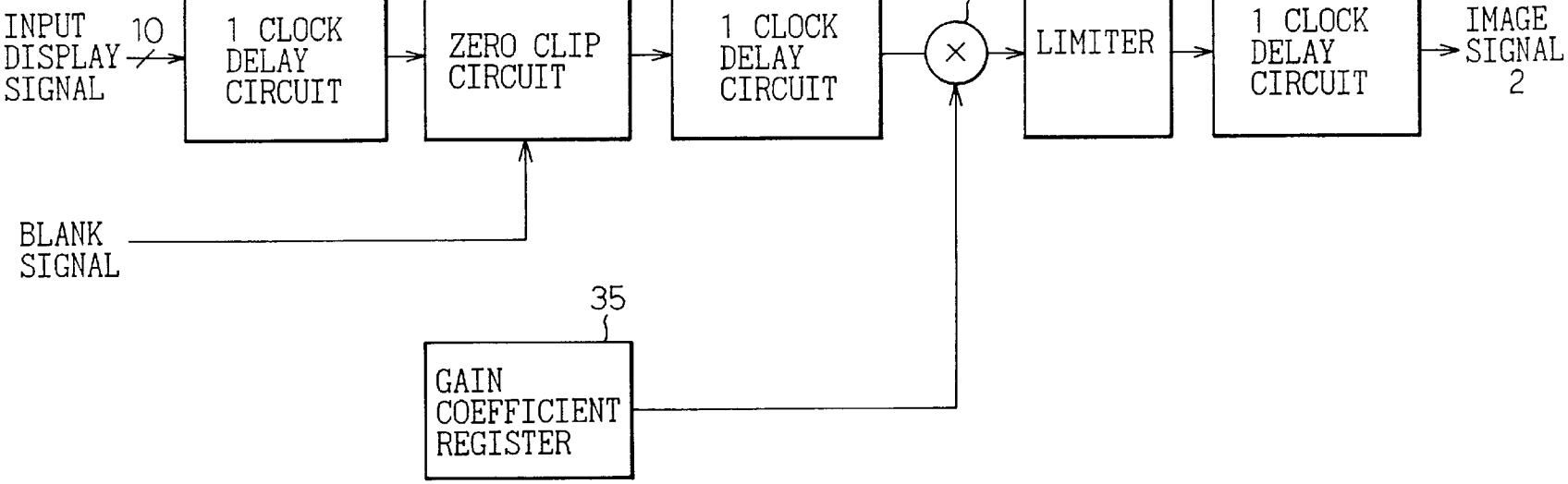
FIG. 9 is a schematic showing the structure of the gain control circuit.

FIG. 9 is a schematic showing the structure of the gain control circuit 21. Each input image signal is a 10-bit RGB signal and is latched in a 1 clock delay circuit 31. A zero clip circuit 32, which puts out a data signal of zero according to a blank signal, is omitted here because it is not of direct concern. The data signal put out from the zero clip circuit 32 is retained in a 1 clock delay circuit 33, and is multiplied in a multiplier 34 by the gain coefficient retained in a gain coefficient register 35. For example, when a gain coefficient is 10-bit, the result of multiplication is 13-bit. The data signal put out from the multiplier 34 is converted to the maximum value in a limiter 36 if it exceeds the specified maximum value, is latched in a 1 clock delay circuit 37, and is supplied to the data converter 12 as an image signal 2.

In a conventional apparatus, the driver controller 22 generates the gain coefficient according to the value set by the luminance control circuit to adjust the display luminance or the like, or the set value stored in a ROM, sets it to the gain coefficient register 35, and it is not altered automatically depending on the input image signal. In the apparatus in the present embodiment, on the other hand, the power control circuit 23 generates the gain coefficient according to the display conditions and sets it to the gain coefficient register 35.

The driver controller 22 generates a gain coefficient 1 according to the abovementioned set value and supplies it to the power control circuit 23. The power control circuit 23 calculates the power consumption P based on the detected values of the voltage and current supplied from the power source 5, determines a gain coefficient 2 and the total number of radiation pulses n that will be set to the gain register 35 in the gain control circuit 21, using the gain coefficient 1 and the power consumption, and further determines the number of radiation pulses (number of sustaining pulses) for each subframe SF. The process of determining the gain coefficient 2, the total number of radiation pulses, and the number of radiation pulses for each SF is explained below.

Figure 7:
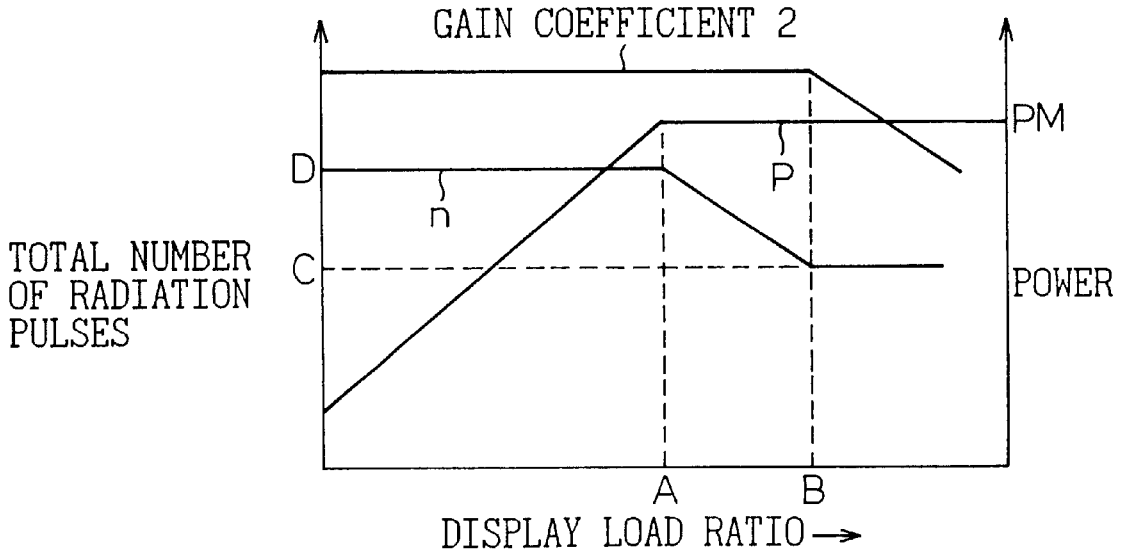
FIG. 7 is a schematic explaining the principle of the present invention.

As shown in FIG. 7, the lower limit C of the total number of radiation pulses that prevents a poor gray scale representation and the limit value PM of the power. consumption should be determined in advance. At first, the gain coefficient 2 is set so as to be equal to the gain coefficient 1 and set to the gain coefficient register 35 in the gain control circuit 21. The total number of radiation pulses n is set to the initial value D, the number of radiation pulses for each SF is set to the total number of radiation pulses D multiplied by the ratio of the luminance of each SF, and they are put out to the driver controller 22. At this time, the decimal numbers are rounded off. Display is carried out under these conditions and whether or not the power consumption P is below the limit value PM is monitored. When the power consumption P is below the limit value PM, the gain coefficient 2 and the total number of radiation pulses D should be maintained.

When the power consumption P exceeds the limit value PM, the total number of radiation pulses n, which is required to drop the power consumption below the limit value PM, is calculated based on the display load ratio. When the calculated total number of radiation pulses n is larger than the lower limit C, the gain coefficient 2 should be maintained at the initial set value (equal to the gain coefficient 1), the number of radiation pulses for each SF is set to the total number of radiation pulses n multiplied by the ratio of luminance of each SF, and they are put out to the driver controller 22. As a result, the power consumption P does not exceed and is kept below the limit value PM.

When the calculated total number of radiation pulses n is below the lower limit C, the total number of radiation pulses is changed to the lower value C, the number of radiation pulses for each SF is set to the total number of radiation pulses C multiplied by the ratio of the luminance of each SF, and they are put out to the driver controller 22 and at the same time, the gain coefficient 2 is reduced gradually from the initial set value (gain coefficient 1). The reduction rate is arbitrary. As a result, the power consumption P becomes below the limit value PM.

Under these conditions, the gain coefficient 2 is reduced or increased gradually so that the power consumption P is controlled to become below the limit value PM, but when the power consumption P is reduced and the gain coefficient 2 exceeds the initial set value (gain coefficient 1) again, the gain coefficient 2 is set to the initial set value (gain coefficient 1) and the total number of radiation pulses is increased. When the power consumption P is reduced further below the limit value PM, the total number of radiation pulses n is set to the initial value D, and the number of radiation pulses for each SF is set to the total number of radiation pulses D multiplied by the ratio of the luminance of each SF.

The embodiments of the present invention have been explained above. However, it is also possible, when input image signals are analog, to use a gain-variable analog amplifier to adjust the gain instead of the gain control circuit for digital processing shown in FIG. 9, and supply them to the data converter 12 after conversion into digital signals by an A/D converter. The gain of the analog amplifier circuit is fixed and it is possible to actually alter the gain of the input image signal by changing the reference voltage.

Though it is also possible to control the power consumption by reducing the gain of the input image signal instead of the total number of radiation pulses n, when the power consumption P exceeds the limit value PM, this may generate problems in that the number of gray levels to be displayed is reduced substantially, and the color false contour occurs easily because almost all the highly-weighted subframes are not lit. Therefore, the control method of the present invention can provide displays of higher quality, in which the total number of radiation of pulses n is reduced first when the power consumption P exceeds the limit value PM, and the gain is reduced after the lower limit value C is reached, above which the displays with gray scale are of excellent quality.

As explained so far, according to the present invention, displays that lack realism can be avoided and displays of good quality can be maintained constantly because the power consumption is carried out in two stages in accordance with the display load.

What is claimed is:

1. A method of driving a display panel equipped with plural cells that carry out discharge for light emission selectively and a display luminance of which is determined by a number of times the discharge for light emission is performed, wherein: a display frame of a screen comprises plural subframes, each of the subframes being assigned a number of times the discharge for light emission is performed according to a specified luminance relation; a representation of a gray scale is performed by combining the subframes in which a display is presented according to an intensity of an input image signal for each cell; and a control of power consumption is carried out by both a control of a total number of times discharge for light emission is performed, and a control of a gain of the input image signal, wherein the control of the power consumption is carried out by first reducing the total number of times discharge for light emission is performed with the gain being set to a constant value, and after the total number of times discharge for light emission is performed is reduced to a threshold value, setting the total number of times discharge for light emission is performed to the threshold value and then reducing the gain.

2. The method of driving a display panel, as set forth in claim 1, wherein the threshold value of the total number of times discharge for light emission is performed is a minimum number of times discharge for light emission is performed required to maintain the specified luminance relation between the plural subframes.

3. The method of driving a display panel, as set forth in claim 1, wherein the threshold value of the total number of times discharge for light emission is performed can be set from an outside of the display panel.

4. A panel display apparatus equipped with a display panel having plural cells that carry out discharge for light emission selectively, wherein: a display luminance is determined by a number of times discharge for light emission is performed; a display frame of a screen is comprised of plural subframes each of which is assigned a number of times discharge for light emission is performed according to a specified luminance relation; and a representation with gray scale is performed by combining the subframes that display according to an intensity of an input image signal for each cell, comprising a gain control circuit that controls a gain of the input image signal, a data converter that loads display data for each said display frame of the input image signal on a frame memory equipped with a display plane corresponding to the plural subframes, and reads from each said display plane in synchronization with a display of the display panel, a driver controller to control a driver that applies drive signals to each electrode of the display panel, and a power control circuit to control power consumption by both a control of a total number of times discharge for light emission is performed in the display frame and a control of the gain of the input image signal, wherein the power control circuit first reduces the total number of times discharge for light emission is performed with the gain being set to a constant value, and then reduces the gain after the total number of times discharge for light emission is performed is reduced to a threshold value, with the total number of times discharge for light emission is performed being fixed to the threshold value.

5. The panel display apparatus, as set forth in claim 4, wherein the threshold value of the total number of times discharge for light emission is performed is a minimum number of times discharge for light emission is performed required to maintain the specified luminance relation between the plural subframes.

6. The panel display apparatus, as set forth in claim 4, wherein the threshold value of the total number of times discharge for light emission is performed can be set from an outside of the panel display apparatus.

7. A method of driving a display panel defined by plural discharge cells to provide light emission by selective discharges of the plural discharge cells in plural subframes, a display frame of a screen comprising the plural subframes, a display is presented by combining the plural subframes according to an intensity of an input image signal for each of the plural discharge cells in the display frame, comprising:

controlling a power consumption of the display panel by coordinated controlling in the display frame of both a total number of discharges of the plural discharge cells and a gain of the input image signal, wherein the power consumption of the display panel is controlled to less than or equal to a first power consumption level, said controlling comprises, when the power consumption of the display panel reaches a first power consumption level, reducing, in the display frame, the total number of discharges of the plural discharge cells with the gain of the input image signal being set to a first value, and after the total number of discharge of the plural discharge cells is reduced to a threshold value, the total number of discharges of the plural discharge cells is set to the threshold value and the gain of the input image signal is reduced, thereby ensuring the power consumption of the display panel is less than or equal to the first power consumption level.

8. The method of driving a display panel, as set forth in claim 7, wherein the threshold value of the total number of discharges of the plural discharge cells is a minimum number of discharges of the plural discharge cells to maintain a specified luminance relation between the plural subframes.

9. The method of driving a display panel, as set forth in claim 7, wherein the threshold value of the total number of discharges of the plural discharge cells is settable from an outside of the display panel.

10. A method of driving a display panel defined by plural discharge cells to provide light emission by selective discharges of the plural discharge cells in plural subframes, a display frame of a screen comprising the plural subframes, a display is presented by combining the plural subframes according to an intensity of an input image signal for each of the plural discharge cells in the display frame, comprising:

controlling a power consumption of the display panel by coordinated controlling in the display frame of both a total number of discharges of the plural discharge cells and a gain of the input image signal, wherein the power consumption of the display panel is controlled to less than or equal to a first power consumption level, said controlling comprises, when a display load ratio is at or below a first value corresponding to the power consumption of the display panel at or below a first power consumption level, operating, in the display frame, the total number of discharges of the plural discharge cells at a first level and the gain of the input image signal at a first gain value, and when a display load ratio is above the first value corresponding to the power consumption of the display panel being above the first power consumption level when the total number of discharges of the plural discharge cells is set to the first level and the gain of the input image signal is set to the first gain value, operating, in the display frame, at one of the total number of discharges of the plural discharge cells ranging between the first level and a second level, the second level being less than the first level, and the gain of the input image signal being set at the first gain value and the total number of discharges of the plural discharge cells being set at the second level and the gain of the input image signal being set at less than the first gain value, thereby ensuring the power consumption of the display panel is less than or equal to the first power consumption level.

11. The method of driving a display panel, as set forth in claim 10, wherein the second level is a level to maintain a specified luminance relation between the plural subframes by setting a minimum number of discharges of the plural discharge cells in the display frame.

12. The method of driving a display panel, as set forth in claim 10, wherein the first and second levels are settable from an outside of the display panel.

13. A panel display apparatus with a display panel having plural discharge cells to provide light emission by selective discharges of the plural discharge cells in plural subframes, a display frame of a screen comprising the plural subframes, a display is presented by combining the plural subframes according to an intensity of an input image signal for each of the plural discharge cells in the display frame, comprising:

a gain control circuit to control a gain of the input image signal; and a power control circuit to control power consumption by coordinated control, in the display frame, of both a total number of discharges of the plural discharge cells and the gain of the input image signal, wherein the power control circuit reduces the total number of discharges of the plural discharge cells to a threshold value with the gain of the input image signal being set to a first value, and then reduces the gain after the total number of discharges of the plural discharge cells is reduced to the threshold value, with the total number of discharges of the plural discharge cells fixed to the threshold value.

14. The panel display apparatus, as set forth in claim 13, wherein the threshold value of the total number of discharges of the plural discharge cells is a minimum number of discharges of the plural discharge cells to maintain a specified luminance relation between the plural subframes.

15. The panel display apparatus, as set forth in claim 13, wherein the threshold value of the total number of discharges of the plural discharge cells is settable from an outside of the panel display apparatus.

16. A panel display apparatus with a display panel having plural discharge cells to provide light emission by selective discharge of the plural discharge cells in plural subframes, a display frame of a screen comprising the plural subframes, each of the plural subframes being assigned a number of discharges of the plural discharge cells to be performed according to a specified luminance relation; a representation defined by gray scale levels is performed by combining the plural subframes such that a display is presented according to an intensity of an input image signal for each of the plural discharge cells in the display, comprising:

a frame memory with a display plane corresponding to the plural subframes;

a gain control circuit to control a gain of the input image signal;

a data converter to load display data of the input image signal for each said display frame on the frame memory and to read from each said display plane in synchronization with the display of the display panel;

a driver controller to control a driver that applies drive signals to each electrode of the display panel; and a power control circuit to control power consumption by coordinated control, in the display frame, of both a total number of discharges of the plural discharge cells and the gain of the input image signal, wherein the power control circuit first reduces the total number of discharges of the plural discharge cells with the gain being set to a constant value, and then reduces the gain after the total number of discharges of the plural discharge cells is reduced to a threshold value, with the total number of discharges of the plural discharge cells being fixed to the threshold value.

17. A method of driving a display panel equipped with plural cells that perform discharge for light emission selectively, the display panel having a display luminance thereof determined by a number of times the discharge for light emission is performed, a display frame comprising plural subframes, each of the subframes being assigned a portion of the number of times the discharge for light emission is performed by combining the subframes in which a display is presented according to an intensity of an input image signal for each of the plural cells, and a control of power consumption performed by both a control of a total number of times the discharge for light emission is performed, and a control of a gain of the input image signal, comprising controlling of the power consumption by:

controlling the total number of times discharge for light emission is performed according to a display load ratio with the gain being set to a constant value; and controlling the gain of the input image signal according to a display load ratio with the total number of times the discharge for light emission is performed being set to a constant value, the controlling of the total number of times discharge for light emission is performed when the display load ratio is less than a predetermined value and the controlling of the gain of the input image signal is performed when the display load ratio is larger than the predetermined value.

18. A method of driving a display panel having plural discharge cells to provide light emission by selective discharge of the plural discharge cells in plural subframes, a display frame of a screen comprising the plural subframes, each of the plural subframes being assigned a number of discharges of the plural discharge cells, the display panel having a display luminance thereof determined by the number of discharges of the plural discharge cells and by a combination of the plural subframes in which a display is presented according to an intensity of an input image signal for each of the plural discharge cells, and having a control of power consumption performed by both a control of a total number of discharges of the plural discharge cells, and a control of a gain of the input image signal, comprising:

controlling the total number of discharges of the plural discharge cells according to a display load ratio with the gain being set to a constant value; and controlling the gain of the input image signal according to a display load ratio with the total number of discharges of the plural discharge cells being set to a constant value, the controlling of the total number of discharges of the plural discharge cells being performed when the display load ratio is less than a predetermined value and the controlling of the gain of the input image signal being performed when the display load ratio is larger than the predetermined value.

19. The method of driving a display panel, as set forth in claim 1, wherein the total number of times discharge for light emission is performed is continuously reduced when the total number of times discharge for light emission is performed is reduced.

20. The panel display apparatus, as set forth in claim 4, wherein the total number of times discharge for light emission is performed is continuously reduced when the total number of times discharge for light emission is performed is reduced.

21. The method of driving a display panel, as set forth in claim 7, wherein the total number of discharges of the plural discharge cells is continuously reduced when the power consumption of the display panel reaches the first power consumption level.

22. The method of driving a display panel, as set forth in claim 10, wherein when the total number of discharges of the plural discharge cells is between the first level and the second level, a change in the total number of discharges of the plural discharge cells is continuous.

23. The panel display apparatus, as set forth in claim 13, wherein the total number of discharges of the plural discharge cells is continuously reduced when the power control circuit reduces the total number of discharges of the plural discharge cells.

24. The panel display apparatus, as set forth in claim 16, wherein the total number of discharges of the plural discharge cells is continuously reduced when the power control circuit reduces the total number of discharges of the plural discharge cells.

25. The method of driving a display panel, as set forth in claim 17, wherein the total number of times discharge for light emission is performed is continuously changed according to a display load ratio when the controlling of the total number of times discharge for light emission is performed.

26. The method of driving a display panel, as set forth in claim 18, wherein the total number of discharges of the plural discharge cells is continuously changed according to a display load ratio when the controlling of the total number of discharges of the plural discharge cells is performed.

* * * * *